United States Patent [19]

Jones

[11] 3,936,175

[45] Feb. 3, 1976

[54] INTERNALLY SHIELDED TRANSFER ROLLER

[75] Inventor: Robert N. Jones, Fairport, N.Y.

[73] Assignee: Xerox Corporation, Stamford, Conn.

[22] Filed: Jan. 29, 1975

[21] Appl. No.: 545,079

[52] U.S. Cl. ..... 355/3 TR; 317/262 A; 96/1.4

[51] Int. Cl.[2] ..... G03G 15/00

[58] Field of Search ..... 355/3 TR, 3 R; 317/262 A; 96/1.4

[56] References Cited

UNITED STATES PATENTS 3,830,589 8/1974 Allen ..... 355/3 TR 3,847,478 11/1974 Young ..... 355/3 TR

*Primary Examiner*—R. N. Envall, Jr.

[57] ABSTRACT

A biased roller electrostatographic image transfer system in which the image transfer fields are generated by a biased conductive member inside the roller and tailored by a partially surrounding stationary conductive shield which is also inside the roller. The shield extends over the pre-nip area to suppress undesired pre-nip transfer fields, but is apertured in the nip area to allow a high transfer field to be applied therethrough the shield.

14 Claims, 2 Drawing Figures

INTERNALLY SHIELDED TRANSFER ROLLER

Figure 1:
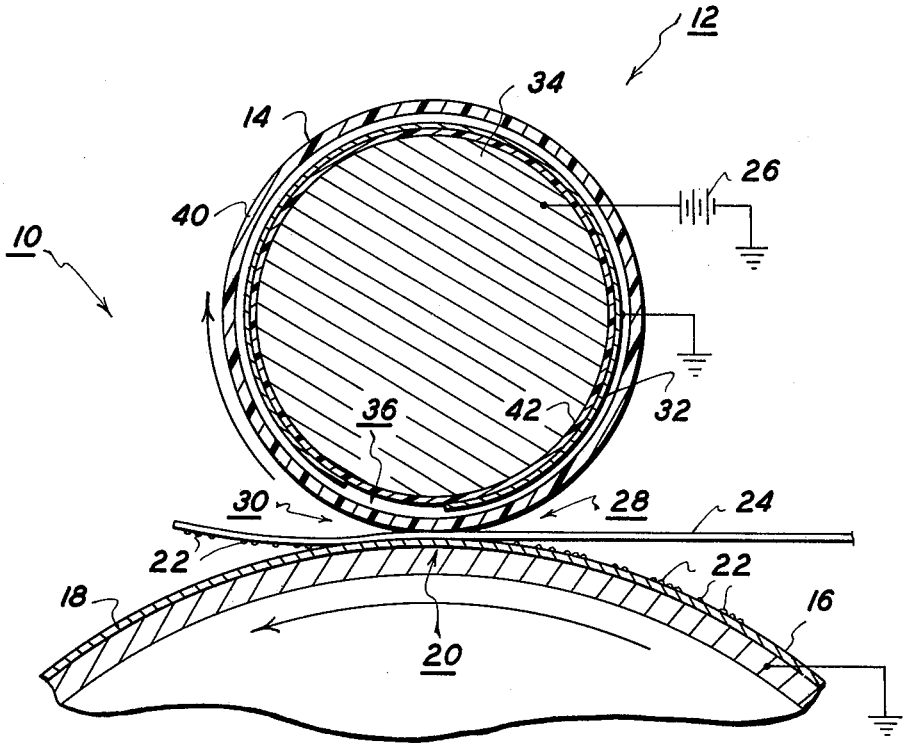

The present invention relates to a biased roller image transfer system in electrostatography in which the transfer fields are tailored by a stationary conductive shield inside the roller.

In a conventional transfer station in electrostatography, toner (image developer material) is transferred from the photoreceptor (the original support and imaging surface) to the copy sheet (the final support surface or transfer member). The toner is then fixed to the copy sheet, typically in a subsequent thermal fusing station.

In xerography, transfer is most commonly achieved by electrostatic force fields created by D.C. charges applied to the back of the copy sheet while the front side of the copy sheet contacts the toner-bearing photoreceptor surface. The transfer field must be sufficient to overcome the forces holding the toner onto the photoreceptor and to attract the toner over onto the copy sheet. These transfer fields are generally provided in one of two ways: by ion emission from a transfer corotron onto the copy paper, as in U.S. Pat. No. 2,807,233; or by a D.C. biased transfer roller or belt rolling along the back of the paper and holding it against the photoreceptor.

The present invention relates to bias roller transfer systems. Some general examples are described in U.S. Pat. Nos. 2,807,233; 3,043,684; 3,267,840; 3,328,193; 3,598,580; 3,625,146; 3,630,591; 3,684,364; 3,691,993; 3,702,482; 3,781,105; 3,832,055; and 3,847,478.

The use of apertured grounded shields to affect transfer between a master drum and a biased drum in a type of electrical printing is disclosed in U.S. Pat. No. 3,399,611, issued Sept. 3, 1968, to K. G. Lusher. A grounded shield extending between a transfer corona generator and a xerographic drum to affect the ion stream and prevent premature transfer is disclosed in U.S. Pat. No. 3,850,519, issued Nov. 26, 1974, to D. J. Weikel, Jr.

The difficulties of successful electrostatographic image transfer are well known. In the pre-transfer (pre-nip) region or area, before the copy paper contacts the image, if the transfer fields are high the toner image is susceptible to premature transfer across too great an air gap, leading to decreased image resolution and, in general, to fuzzy images. Further, if there is pre-nip ionization, it may lead to strobing defects, loss of transfer efficiency, or "splotchy" transfer and a lower latitude of acceptable system operation. In the post-nip region, at the photoconductor-paper separation area, if the transfer fields are too low (e.g., less than approximately 12 volts per micron for lines and 6 volts per micron for solid areas) hollow characters may be generated, especially with smooth papers, high toner pile heights and high nip pressures (greater than approximately 0.07 kg per square cm). If the fields in certain portions of the post-nip region are otherwise improper, the resulting ionization may cause image instability and paper detaching. On the other hand, in the nip region itself, to achieve high transfer efficiency and avoid retransfer, the transfer field should be as great as possible (greater than approximately 20 volts per micron). To achieve these desired different and non-symmetrical fields in these adjacent regions consistently and with appropriate transitions is difficult, especially where the air gaps are defined by the symmetrical geometry of a cylindrical roller.

The transfer system of the invention is inteded to overcome many of these problems with a simple transfer roller structure. It may be utilized for transfer with an imaging surface of any desired configuration, such as cylinder or a belt. It may also be used for transfer to an intermediate surface rather than a final copy surface, and for duplex as well as simplex transfer systems.

The above-cited and other references teach details of various suitable exemplary xerographic or other electrostagographic structures, materials, systems and functions known to those skilled in the art, and are incorporated by reference in this specification, where appropriate. Accordingly, the following description is confined to the novel aspects of the present invention.

Figure 2:
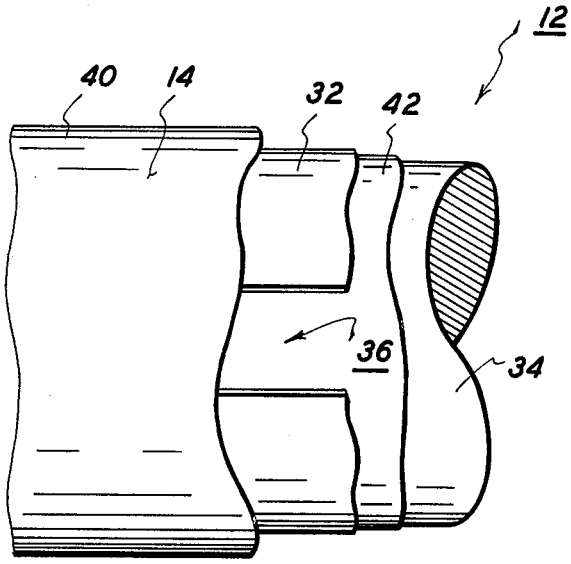

Further objects, features and advantages of the present invention pertain to the particular apparatus and details whereby the above-mentioned aspects of the invention are attained. Accordingly, the invention will be better understood by reference to the following description of one example thereof, and to the drawings forming a part of the description, which are substantially to scale, wherein:

FIG. 1 is an axial cross-sectional view of an exemplary biased roller transfer system in accordance with the present invention; and FIG. 2 is a bottom view of the transfer roller of FIG. 1, with its components partially broken away in sequence to more clearly illustrate its construction.

Referring to FIGS. 1 and 2, there is shown therein the transfer station of an exemplary electrostatographic copying system 10 comprising a cylindrical transfer roller member 12 providing an example of the present invention. The cylindrical outer surface 14 of the transfer member 12 engages the imaging surface 16 of a conventional photoreceptor 18 to define a transfer nip 20. In the transfer nip 20, toner particles 22 are transferred from the imaging surface 16 to the facing surface of a copy sheet 24 passing through the transfer nip 20. The copy sheet 24 is held against the imaging surface 16 by the transfer member 12 and transfer is affected by electrical transfer fields generated between the transfer member 12 and the imaging surface 16. These transfer fields are generated by applying an electrical bias from a bias voltage source 26 to the transfer member 12, and by providing a grounded substrate for the photoreceptor 18. It will be appreciated that an image-wise pattern of the toner 22 is formed on the imaging surface 16 by suitable conventional electrostatographic processes prior to its entry into the transfer station.

It may be seen that upstream of the transfer nip 20 there is a pre-transfer area 28 in which there is an air gap between the outer surface 14 of the transfer member 12 and the imaging surface 16. In the pre-transfer region 28 there is also an air gap between the copy sheet 24 and the imaging surface 16 as it moves into engagement therewith. Correspondingly, there is a post-transfer area 30 downstream of the transfer nip 20.

It may be seen that the transfer member 12 here differs from a conventional bias transfer roller in that there is a stationary conductive electrostatic shield 32 inside the transfer roller shielding the biased conductive core 34 of the roller. This shield 32 is coaxial and concentric the roller and has an aperture 36 extending in length along the roller. It may be seen that this aperture 36 is non-symmetrical relative to the nip area 20 in width, providing an opening only in the nip area 20 and the post-nip area 30, but not in the pre-nip area 28. Thus, the unapertured portion of the shield 32 in the pre-nip area 28 acts to block or shield the electrical field in that area in the manner of a Faraday shield. Yet, the aperture 36 allows the full transfer field to be applied in the transfer nip 20 through the aperture. Prevention of undesirable pre-nip field intensities if provided by this arrangement without requiring any reduction on the roller electrode bias potential, or increase in its spacing, and therefore without a corresponding sacrifice in transfer efficiency.

With the arrangement described herein, the material of the thin-walled, hollow tubular cylinder 40 providing the outer surface 14 of the transfer roller 12 does not need to be an electrically relaxable material as taught, for example, in the above-cited U.S. Pat. No. 3,781,105. A conventional fully or substantially non-conductive plastic or rubber material can be utilized, and is preferred. The wall thickness of the rotating tube 40 should be both thin and uniform so as to not interfere with the applying therethrough of a high and uniform transfer field in the transfer nip 20 between the conductive core 34 and the photoreceptor 18. Preferably the outer surface 14 should be resilient for good nip formation and uniform copy sheet retention against the photoreceptor.

It will be appreciated that both the width and circumferential position of the aperture 36 in the shield 32 may be readily adjusted. Thus, if desired, the area or portion of the post-nip area 30 in which a transfer field is applied may be expanded, or greatly restricted, as desired. For example, the transfer field can be narrowly restricted to the transfer nip area 20 or a portion thereof only. Likewise, if some extention of the transfer field into the beginning of the pre-transfer area 28 is desired, this can also be readily provided.

Considering now in greater detail the exemplary construction of the transfer roller 12, the inner or conductive core transfer member 24 is here stationary, although as long as it is concentric it could also rotate with the roller. However, by being stationary, it can provide an axis for the roller 12 and a non-moving electrical contact can be made therewith directly from the bias voltage source 26. A thin insulating layer 42 is provided here between the conductive core 34 and the closely surrounding shield 32. The shield 32 may be a thin sheet metal tube, which is electrically grounded. Both the shield and core 24 can be mounted stationarily by extending from one or both ends of the roller 12.

It will be appreciated that the entire roller 12, including the above two stationary components, can be pivotally mounted so as to be movable as a unit away from the photoreceptor 18 when not accomplishing transfer, as shown in some of the above-cited references. Thus, by stationary or fixed, it is meant that the core 34 and shield 32 do not rotate with the roller 12 and remains in the same relative position with regard to the transfer nip 20 in the direction of the paper path.

The shield 32 here is directly grounded. It will be appreciated, however, that it could also be biased with a reduced or even opposing bias voltage for somewhat different field tailoring.

It may be seen that the outer surface of the conductive core 34 extends to closely adjacent the interior surface of the outer tube or main portion 40 of the roller 12. Also, the shield 32 and insulating layer 42 are preferably quite thin, so as not to cause the transfer field spacing to be larger than necessary, since any increase in the spacing between the conductive core 34 and the imaging surface 16 causes a reduction in the transfer field for the same applied bias voltage. A small space is provided here between the stationary shield 32 and the interior surface of the outer cylinder 40 to prevent frictional interference. A lubricating surface may be provided therebetween.

It is important to note in the above-described configurations that the conductive shield 32 is inside the rotating and paper engaging body 40 of the roller 12, and not positioned between the outer surface 14 of the roller 12 and the copy sheet 24 or other transfer member. In its disclosed position internal the roller, the shield does not create any undesired transfer air gap between the transfer roller outer surface 14 and the copy sheet 24, and does not create any air gap between the copy sheet 24 and the imaging surface 16. Likewise, it does not prevent the transfer roller from performing its conventional and desired function of holding the copy sheet 24 down directly against the imaging surface 16 for reliable transfer and paper handling. Further, with the disclosed configuration all of the components of the roller 12 to which electrical connections are made can be non-rotating for improved reliability. The actual mechanical roller portion 40 is not electrically biased, rather the transfer field is passed therethrough. (It will be appreciated, of course, that conventional charge neutralizing means may be applied to the roller tube 40 for surface charge neutralization, if desired).

In conclusion, there has been described herein a novel transfer system providing tailored transfer fields with a simple structural arrangement. Numerous modifications and variations thereof will be obvious to those skilled in the art. The following claims are intended to cover all such variations and modifications as fall within the true spirit and scope of the invention.

What is claimed is:

1. In an electrostatographic copying system wherein an image is transferrable from a first support surface to a second image support surface utilizing an electrically biased rotatable transfer roller forming a transfer nip, and adjacent pre and post-nip areas, with said first image support surface for passage of said second image support surface through said transfer nip against said first image support surface for said image transfer, as well as through said pre-nip and post-nip areas, the improvement wherein said transfer roller comprises;

an outer, thin-walled, substantially non-conductive, rotatable tubular member forming said transfer nip, an electrically biased conductive transfer member inside said tubular member providing transfer fields between said conductive transfer member and said first image support surface through said tubular member, and a non-rotatable conductive shield inside said tubular member positioned between said conductive transfer member and said tubular member and between said conductive transfer member and said first image support surface, to block said transfer fields, said conductive shield being apertured at said transfer nip to pass said transfer fields therethrough.

2. The transfer roller of claim 1, wherein said conductive shield is unapertured in said pre-nip area to block transfer fields in said pre-nip area.

3. The transfer roller of claim 1, wherein said conductive shield is electrically grounded.

4. The transfer roller of claim 2, wherein said conductive shield is electrically grounded.

5. The transfer roller of claim 1, wherein said conductive shield is apertured with a single aperture extending in length axially along said roller and extending in width non-symmetrically beyond said transfer nip further into said post-nip area than said pre-nip area.

6. The transfer roller of claim 1, wherein said conductive transfer member has a cylindrical outer surface closely spaced from the interior of said tubular member.

7. The transfer roller of claim 6, wherein said conductive transfer member is non-rotatable.

8. The transfer roller of claim 1, wherein said conductive shield is a thin-walled cylindrical metal tube.

9. The transfer roller of claim 6, wherein said conductive shield is a thin-walled cylindrical metal tube.

10. The transfer roller of claim 1, wherein said conductive shield, said conductive transfer member, and said tubular member are cylindrical and concentric.

11. The transfer roller of claim 5, wherein said conductive shield, said conductive transfer member, and said tubular member are cylindrical and concentric.

12. The transfer roller of claim 1, wherein said conductive shield is a thin-walled cylindrical metal tube extending along said roller over said transfer member, said conductive shield having an aperture extending in length axially along said roller and extending in width non-symmetrically beyond said transfer nip further into said post-nip area than said pre-nip area, and wherein said conductive shield is electrically grounded.

13. The transfer roller of claim 12, wherein said conductive transfer member has a cylindrical outer surface closely spaced from the interior of said tubular member.

14. The transfer roller of claim 13, wherein said conductive transfer member is non-rotatable.

* * * * *